US006712250B2

(12) United States Patent
Vigny

(10) Patent No.: US 6,712,250 B2
(45) Date of Patent: Mar. 30, 2004

(54) ARTICLE OF LUGGAGE WITH OUTER RETAINING DEVICE

(75) Inventor: Serge Vigny, Thorens Glieres (FR)

(73) Assignee: Salomon S.A., Metz-Tessy (FR)

( * ) Notice: Subject to any disclaimer, the term of this patent is extended or adjusted under 35 U.S.C. 154(b) by 36 days.

(21) Appl. No.: 10/190,569

(22) Filed: Jul. 9, 2002

(65) Prior Publication Data

US 2003/0015563 A1 Jan. 23, 2003

(30) Foreign Application Priority Data

Jul. 20, 2001 (FR) ..... 01 09958

(51) Int. Cl.[7] ..... A45F 3/04

(52) U.S. Cl. ..... 224/640; 224/637; 224/650; 224/652

(58) Field of Search ..... 224/580, 582, 224/637, 640, 650, 651, 652, 653; 190/102, 109, 110, 111

(56) References Cited

U.S. PATENT DOCUMENTS

| | | | | | |
|---|---|---|---|---|---|
| 2,324,194 | A | * | 7/1943 | Campiglia | 224/637 |
| 4,739,913 | A | | 4/1988 | Moore | 224/215 |
| 4,790,463 | A | * | 12/1988 | Hansen | 224/680 |
| 5,477,593 | A | | 12/1995 | Leick | 24/712.5 |
| 5,634,579 | A | * | 6/1997 | Baclawski | 224/637 |
| 5,639,005 | A | * | 6/1997 | Chouinard | 224/580 |
| 5,803,333 | A | * | 9/1998 | Fawcett | 224/652 |
| 5,826,771 | A | * | 10/1998 | Peng | 224/651 |
| 5,984,154 | A | * | 11/1999 | Scicluna | 224/653 |
| 6,131,780 | A | * | 10/2000 | Becker | 224/650 |
| 6,179,187 | B1 | * | 1/2001 | Lemire et al. | 224/640 |
| 6,290,114 | B1 | * | 9/2001 | Berberian | 224/637 |

FOREIGN PATENT DOCUMENTS

| | | |
|---|---|---|
| EP | 0612489 | 8/1994 |
| EP | 0629793 | 12/1994 |
| FR | 2736249 | 1/1997 |
| FR | 2754984 | 4/1998 |

* cited by examiner

*Primary Examiner*—Gary E. Elkins
(74) *Attorney, Agent, or Firm*—Greenblum & Bernstein, P.L.C.

(57) ABSTRACT

An article of luggage, of the type having a retaining device for pressing an object against an outer wall of the article of luggage, of the type in which the retaining device includes a flexible tie that runs along a path following the return points borne by the outer wall of the backpack, and of the type in which the length of the tie path can be adjusted due to a clamp whose position on the tie is adjustable, wherein the clamp is affixed to a retaining element that is affixed to the article of luggage but which can be spaced from the outer wall, the object to be pressed being at least partially received between the outer wall and the retaining element, inside the tie path.

15 Claims, 3 Drawing Sheets

ARTICLE OF LUGGAGE WITH OUTER RETAINING DEVICE

CROSS-REFERENCE TO RELATED APPLICATION

This application is based upon French Patent Application No. 01.09958, filed Jul 20, 2001, the disclosure of which is hereby incorporated by reference thereto in its entirety, and the priority of which is hereby claimed under 35 U.S.C. §119.

BACKGROUND OF THE INVENTION

1. Field of the Invention

The invention relates to an article of luggage.

More particularly, the invention relates to luggage in the form of a backpack. However, the invention can be applied to any type of flexible bag, or to semi-rigid or rigid baggage.

2. Description of Background and Relevant Information

Any article of luggage has a main compartment, usually closed, that is adapted to receive the objects that one wishes to carry with such article of luggage, or bag. The main compartment forms the primary portion of the inner volume of the bag. The article could also have outer pockets that form additional closed compartments, and which are adapted to storing objects that one wishes to have immediately available. Lastly, articles of luggage also have outer retaining devices that allow one to fasten additional objects to the outside of the bag. These retaining systems can be constituted by mere straps.

An outer retaining system is shown, for example, in FIG. 7 of document EP-A1-0 612 489. In this figure, one can see a backpack with a retaining device for pressing an object against an outer wall of the bag, in this case on the outer surface of the flap. The retaining device has a flexible tie that runs along a path following return points formed by loops borne by the outer wall of the flap. The length of the path of the tie is adjustable due to a clamp, whose position on the tie is adjustable in order to tighten an object, such as a helmet, a coat or yet other accessories.

Thus, this type of retaining system allows attaching objects to the bag that are relatively bulky, maybe even bulkier than the bag, even if these objects are not really protected, particularly from the rain. Such a retaining device takes up no space when empty and weighs very little, and it is capable of receiving objects of various shapes and sizes.

The drawback raised by this type of retaining device is that it is necessary to use both hands to close the device over the object that one wishes to press against the outer wall of the bag. As a matter of fact, one closes the device by pulling on the free end of the tie with one hand to tighten the object against the outer surface, and by sliding the clamp along the tie with the other hand up to a locking position in which it maintains the tie tensioned against the object to be pressed.

SUMMARY OF THE INVENTION

An object of the invention is to propose a system in which the user could perform the aforementioned closing operation with only one hand. To this end, the invention proposes an article of luggage, of the type having a retaining device for pressing an object against an outer wall of the article of luggage, of the type in which the retaining device has a flexible tie that runs along a path following return points borne by the outer wall of the bag, and of the type in which the length of the tie path is adjustable due to a clamp, whose position on the tie is adjustable, whereby the clamp is affixed to a retaining element which is affixed to the article of luggage but which can be spaced from the outer wall, the object to be pressed being at least partially received between the outer wall and the retaining element on the inside of the tie path.

BRIEF DESCRIPTION OF DRAWINGS

Other characteristics and advantages of the invention will become apparent from reading the following detailed description, with reference to the attached drawings, and in which.

DETAILED DESCRIPTION OF THE INVENTION

Figure 1:
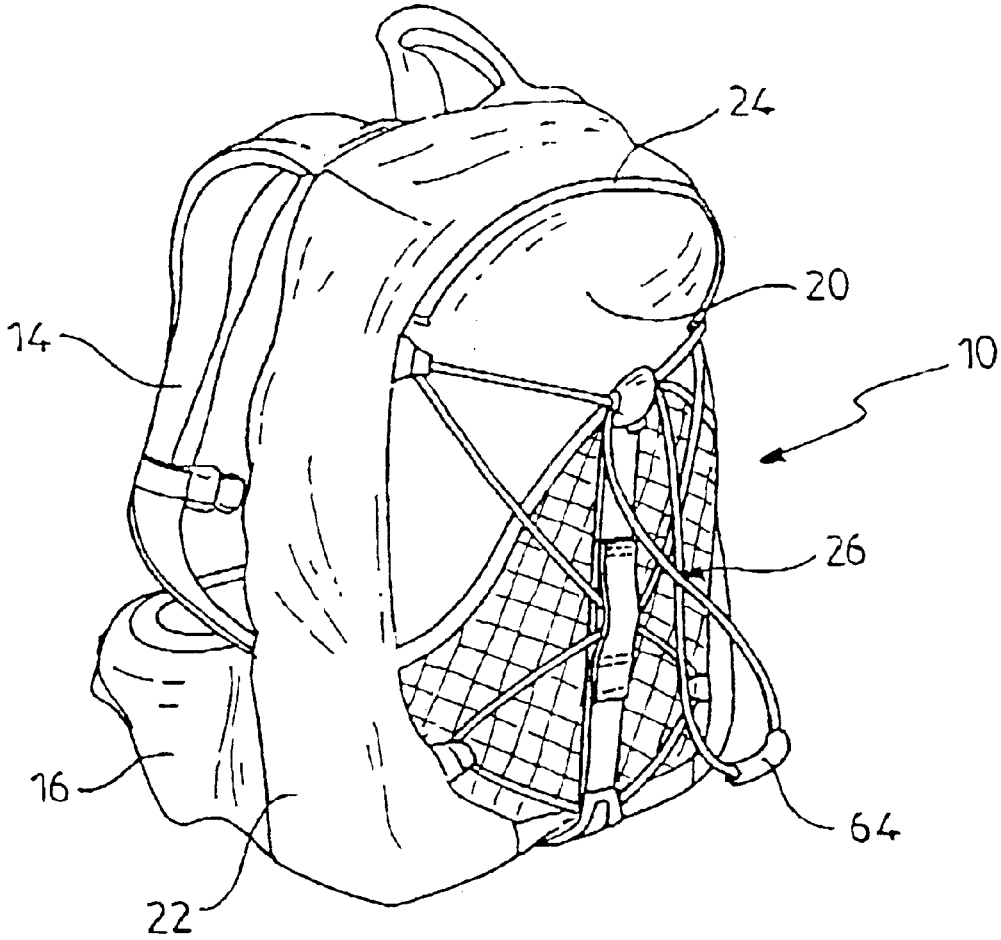
FIG. 1 is a perspective view of a backpack according to the invention.
Figure 2:
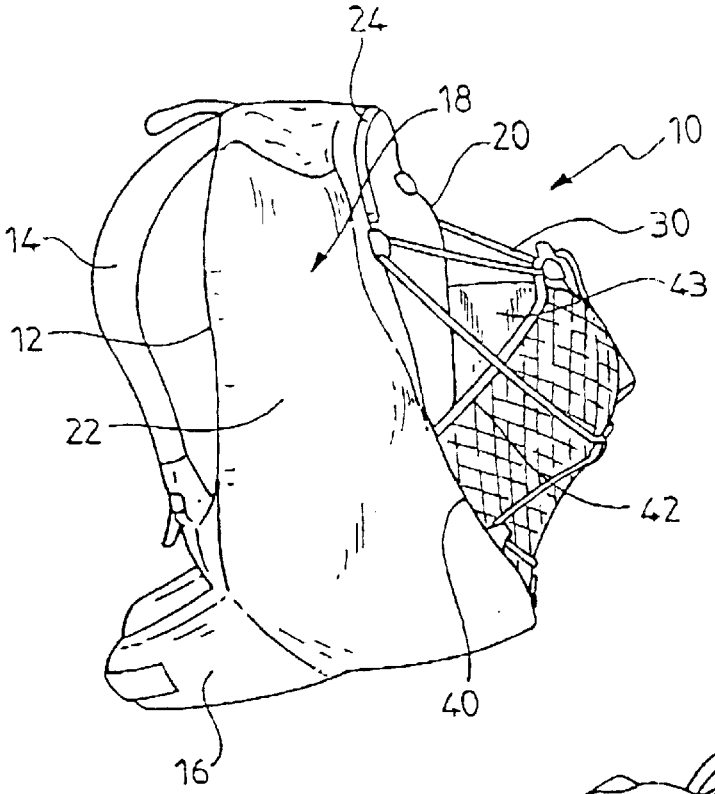
FIG. 2 is a side view of the backpack of FIG. 1.
Figure 3:
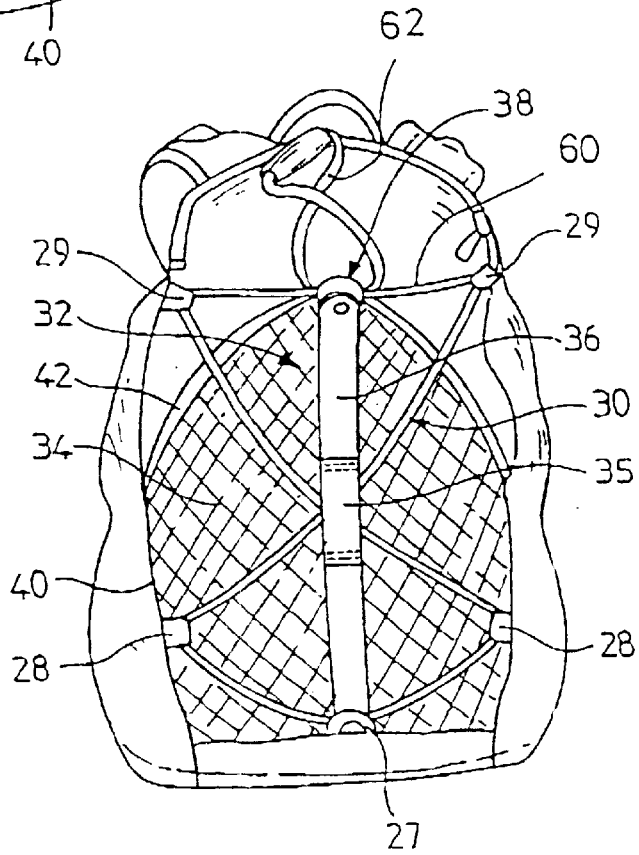
FIG. 3 is a view of the front surface of the backpack of FIG. 1.

FIGS. 1–3 show a carrying bag 10 of the backpack type that has, on a rear wall 12 adapted to come in contact with the user's back, carrying means provided in the form of a pair of shoulder straps 14 allowing one to carry the backpack over the shoulders, and an abdominal belt 16 allowing one to stabilize the lower portion of the backpack, and/or to distribute a portion of the weight of the bag over the user's pelvis.

For a better understanding of the description, the bag 10 hereinafter will be considered as having a main compartment 18 in the shape, substantially, of a parallelepiped, even if in actuality the shape of this compartment is more complex. Similarly, in addition to the convention according to which the rear surface is the one adapted to come into contact with the user's back, the notions of top and bottom, as they apply to a backpack when it is carried in the usual manner by a user, will be referenced. The main compartment 18 will be considered to have, opposite its rear surface 12, a front wall 20 that is joined to the rear wall 12 by two lateral wails 22. The main compartment 18 is therefore demarcated by walls which are preferably made from a flexible material, for example a fabric. The rear wall 12 can have a reinforcement structure (not shown in the figures). The compartment 18 is closed in its lower portion by a stationary bottom, for example, and has, at its upper portion an opening that is defined, for instance, by a zipper 24. The backpack 10 could also have lateral pockets arranged outside the main compartment 18, for instance on the lateral surfaces 22 thereof.

According to the invention, the backpack 10 has a retaining device 26 allowing one to press and attach objects against the front wall 20 of the backpack. This retaining device has five return points 27, 28, 29 through which a tie 30 can slide. The return points 27, 28, 29 are constituted of small loops made from a strip of fabric sewn on the edges of the front surface. One of the return points 27 is located at the center of a lower horizontal edge of the front wall 20, and each of the two lateral vertical edges of the front wall is provided with two return points, one 28 in the lower portion and the other 29 in the upper portion. The return points 28, 29 of the two lateral edges are located vertically opposite one another.

Between the two upper lateral return points 29, the tie passes through a clamp 38 which, according to the teaching of the invention, is maintained by a retaining element 32. In the example shown, the retaining element has a textile panel 34 that covers the lower two-thirds of the front wall 20 of the backpack, and a reinforcement strap 36 that extends vertically along the external side of the textile panel 34, from the lower return point 27 up to the highest point of the textile panel.

More specifically, the textile panel 34 is sewn at a lower edge to the lower edge of the front wall 20 of the backpack, and the bottom portion 40 of its lateral edges is also sewn to the corresponding bottom portion of the front surface. The upper portions 42 of the two lateral edges of the textile panel are free with respect to the front wall 20 of the backpack and meet at a top point that is substantially at the height of the two upper return points 29. The textile panel 34 thus has a free edge that is constituted of the upper portions 42 of the two lateral edges and that can be spaced from the outer wall of the backpack. The free edge of the panel 34 thus demarcates an opening for the space comprised between the panel 34 and the outer surface of the backpack, inside the path of the tie 30; it is an opening through which the objects to be retained are at least partially introduced into this space. The upper portions 42 of the lateral edges are advantageously provided with elastic straps.

The textile panel can be a panel of fabric or constituted of a net which, due to its deforming ability, can better adapt to the shape of any object that is inserted into the space between the panel 34 and the front surface 20. In this case especially, the reinforcement strap 36 is particularly important. The reinforcement strap can be an elastic strap having a predetermined stretching capacity, or on the contrary a substantially inextensible strap, i.e., not stretching more than 5% in a traction force of several tens of kilos. In the example shown, the reinforcement strap 36 is a flexible textile strap that is substantially inextensible. The strap 36 is fixed to the backpack at the edge of its lower end, and the edge of its upper end is free to be spaced from the outer wall 20, like the free edge of the panel 34 with which it coincides.

If the textile panel 34 is obtained in the form of a net, it will then be advantageous to attach the clamp 28 to the reinforcement strap 36, as shown in the figures, especially if the reinforcement strap is substantially inextensible. Indeed, the reinforcement strap can retain the clamp without being deformed, and it will allow closing the retaining device with one hand.

The path of the tie 30 between the return points is an 8-shaped crisscrossed-loop path, i.e., the tie passes directly from one lateral return point 28 located in the bottom portion of one of the lateral edges up to the return point 29 located in the top portion of the other lateral edge of the front surface. Thus, the tie encounters a crossing point in its path. This crossing occurs on the inside of a keeper 35 sewn on the reinforcement strap 36.

In the example shown, the tie includes a section affixed to the backpack. In this case, the tie 30 is constituted of a single tie whose two ends are sewn to the backpack in the area of the lower return point 27. As such, the tie 30 does not slide in the area of the lower return point 27, but it can slide in the area of the four other return points 28, 29.

Figure 5:
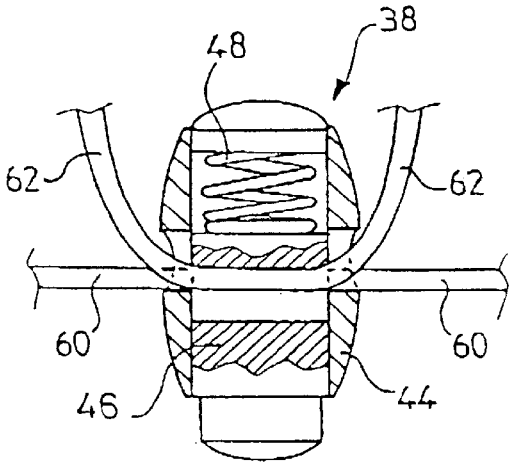
FIGS. 5 and 6 are schematic views showing, in two positions, an embodiment of a clamp that can be used within the scope of the invention.
Figure 6:
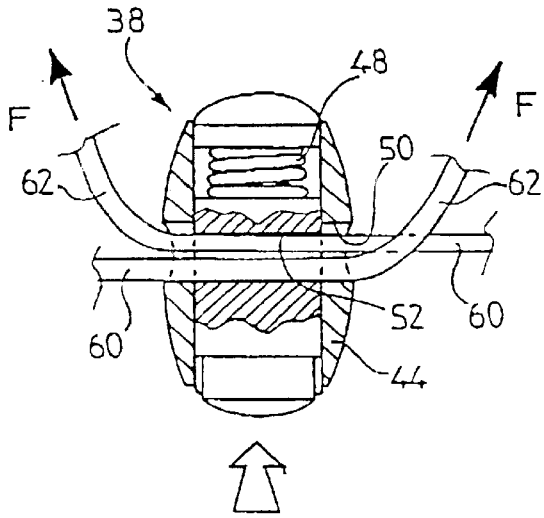

The clamp 38, for instance, is a slide clamp like the one shown in FIGS. 5 and 6. This clamp 38 has a main tubular body 44 that is substantially cylindrical and rotatable, closed at an upper end and open at a lower end (the terms upper and lower are used based on the orientation according to which the clamp is affixed to the backpack in the example shown). A slide 46 can slide vertically in the main body 44, and it is biased downwardly by a spring 48 that is inserted, inside of the main body, between the upper end of the slide and the upper closed end of the main body. The lower end of the slide 46 extends past the exterior of the main body 44 so as to form a push button allowing one to retract the slide 46 into the main body by compressing the spring 48. The main body and the slide each have a transverse bore 50, 52, and the two bores can be aligned with one another (until they are substantially coaxial) when the slide 46 is retracted by compressing the spring 48.

The strands of the tie 30, one originating from the right upper return point 29 and the other originating from the left upper return point 29, pass through the clamp and are received in the two bores 50, 52. When the two bores 50, 52 are substantially coaxial, the two strands of the tie 30 can slide freely with respect to the clamp 32. When the push button is released, the spring 48 causes the downward displacement of the slide 46 by offsetting the bores 50, 52, until the strands of the tie are wedged by shearing between the bores 50, 52.

In FIG. 3, it can be seen that when the retaining element lays flat, when empty, against the outer wall 20, the clamp 38 is located on the perimeter that connects the return points 27, 28, 29. It could also be positioned inside of this perimeter.

Figure 4:
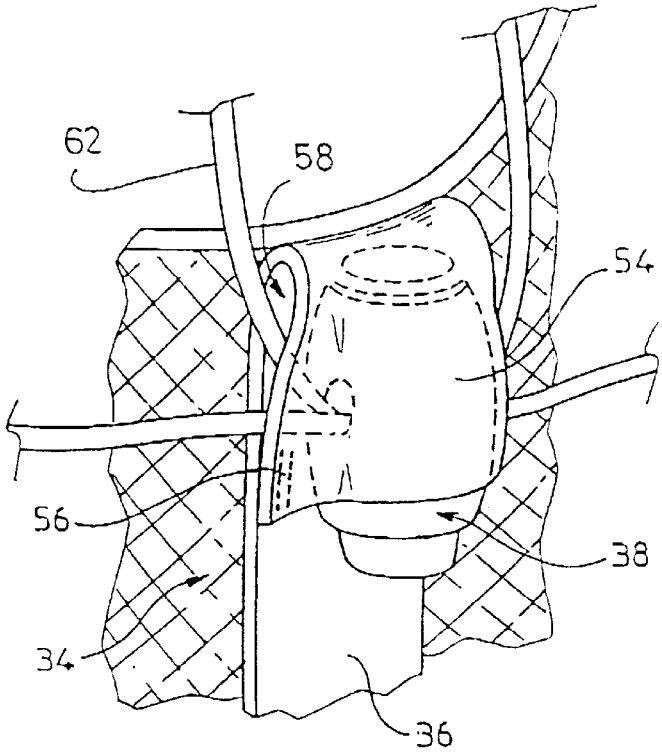
FIG. 4 is a detailed perspective view with a partial tear out of an embodiment of the attachment of the clamp to the retaining element.

As seen in FIG. 4, the clamp 38 is fixed to the retaining element in a position such that the bores 50, 52 are substantially parallel to the direction of the tie strands originating from the upper return points 29. To this end, the upper end of the reinforcement strap 36 is folded vertically downward on itself, and the flap 54 thus formed is fixed to the strap 36 by two vertical stitches 56 made on the lateral edges of the flap 54 and the strap 36. The stitches 56 do not extend up to the upper fold of the strap 36 so as to leave a passage 58 for the tie strands. The flap 54 thus forms a housing that is closed toward the top in which the clamp can be wedged, and the push button formed by the lower end of the slide 46 extends downwardly outside of the housing. The clamp is thus arranged in the immediate proximity of the free edge of the retaining element, at the center of the edge.

It is noted that the clamp demarcates for each of the two tie strands a useful section 60, that extends from one side of the clamp towards one of the upper return points 29 and which is taut when the retaining device is tightened on an object 43, and a free section 62 on which the user can pull in order to tighten the retaining device.

In the embodiment shown, in which the tie 30 is in one single piece and has two ends affixed, to the backpack in the area of the lower return 27, the two free sections 62 are constituted of the central portion of the tie 30 and, therefore, are provided to be in the continuity one of the other by forming a loop. The loop can be equipped with a traction grip 64 that allows, by pulling upwardly opposite the reinforcement strap 36, to pull simultaneously and equally on the two useful strands 60. The tightening of the retaining device is thus always symmetrical.

The orientation of the clamp with respect to the orientation of the sections 60, 62 of the strands of the tie 30 is particularly advantageous. Indeed, the sliding direction of the clamp slide is substantially perpendicular to the general direction connecting the two return points 29 between which the clamp 38 is located on the path of the tie 30. As can be seen in FIG. 5, the useful sections 60 on which the tension is exerted are substantially perpendicular to the sliding direction of the slide 46 of the clamp, and this tension does not exert a force on the slide that could facilitate the unlocking of the clamp. On the contrary, one can see in FIG. 6 that when the user tensions the free sections 62 by pulling upwardly along a force F, these free sections exert a force on the slide 46 that tends to bring it to its unlocking position with respect to the main body. Thus, the clamp is at least partially deactivated due to the orientation of the free strands, which decreases the resistance of the retaining system during tightening.

The clamp that is described here is rather simple and therefore inexpensive. Nevertheless, the invention can be embodied with other types of clamps, for instance, a clamp of the type described in the document EP-0 629 793.

Due to the fact that the clamp is affixed to the retaining element 32, the user does not need to hold or displace the clamp when it is desired that the retaining device be tightened. Furthermore, by attaching the clamp to the retaining element 32 which can be spaced from the backpack, and not directly to the backpack, the clamp does not hinder the insertion or removal of the object under the retaining device.

In the context of the invention, the retaining element is constituted, in the example described, of the textile panel 34 and of the reinforcement strap 36 which are associated with one another. However, the retaining element could be constituted of only one of these two elements. In particular, if the objects to be carried are very bulky, the retaining element could be constituted only of the reinforcement strap 36 as the bulky object will be efficiently retained by the tie and the strap alone. The textile panel will be used advantageously if the objects to be carried are small objects.

What is claimed is:

1. An article of luggage comprising:

a retaining device for pressing an object against an outer wall of the article of luggage, the retaining device including a flexible tie running along a path following return points borne by the outer wall of the backpack;

said tie having a path that has an adjustable length due to a clamp having an adjustable position on the tie;

said clamp being affixed to a retaining element affixed to the article of luggage but which can be spaced from said outer wall, the object to be pressed being at least partially received between said outer wall and said retaining element, inside said tie path.

2. An article of luggage according to claim 1, wherein the retaining element is a flexible piece.

3. An article of luggage according to claim 1, wherein the retaining element is substantially inextensible.

4. An article of luggage according to claim 1, wherein the retaining element comprises a textile strap.

5. An article of luggage according to claim 1, wherein the retaining element comprises a textile panel.

6. An article of luggage according to claim 1, wherein the retaining element comprises a fixed edge connected to the outer wall of the article of luggage and a free edge that can be spaced from the outer wall, and wherein the clamp is fixed to the retaining element in the proximity of its free edge.

7. An article of luggage according to claim 6, wherein the free edge of the retaining element defines an opening through which an object can be inserted between the outer wall and the retaining element.

8. An article of luggage according to claim 7, wherein the clamp is located substantially in the center of the free edge of the retaining element.

9. An article of luggage according to claim 1, wherein, on a portion of its path, the flexible tie is fixed to the outer wall of the article of luggage.

10. An article of luggage according to claim 1, wherein, when the retaining element is pressed, when empty, against the outer wall, the clamp is located on the perimeter connecting the return points, or inside of said perimeter.

11. An article of luggage according to claim 1, wherein the clamp is traversed by two tie strands, each strand thus comprising, on both sides of the clamp, a useful section that runs along the path and a free section.

12. An article of luggage according to claim 11, wherein the free sections of the tie strands are in the continuity one of the other and form a closed loop.

13. An article of luggage according to claim 11, wherein the useful sections of the tie each have a distinct end that is fixed to the article of luggage.

14. An article of luggage according to claim 1, wherein the tie path is a crisscrossed path, and in that the crisscrossing of the tie occurs in a keeper affixed to the retaining element.

15. An article of luggage according to claim 1, wherein the clamp is a clamp with a sliding slide, and wherein the sliding direction of the slide is substantially perpendicular to the general direction that connects the two return points between which the clamp is located on the tie path.

* * * * *